US006074558A

United States Patent [19]

Duyvesteyn et al.

[11] Patent Number: 6,074,558

[45] **Date of Patent: *Jun. 13, 2000**

[54] BIOCHEMICAL TREATMENT OF BITUMEN FROTH TAILINGS

[75] Inventors: Willem P. C. Duyvesteyn; Julia Rose Budden; Bernardus Josephus Huls, all of Reno, Nev.

[73] Assignee: BHP Minerals International Inc., Reno, Nev.

[ * ] Notice: This patent is subject to a terminal disclaimer.

[21] Appl. No.: 09/193,332

[22] Filed: Nov. 16, 1998

[51] Int. Cl.[7] ..... C02F 3/34; C10G 1/04; C10G 32/00

[52] U.S. Cl. ..... 210/611; 208/390; 208/45; 435/281

[58] Field of Search ..... 210/610, 611, 210/631; 435/281; 208/45, 86, 87, 390

[56] References Cited

U.S. PATENT DOCUMENTS

| | | | |
|---|---|---|---|
| 3,997,398 | 12/1976 | Zajic et al. | 435/281 |
| 4,349,633 | 9/1982 | Worne et al. | 435/281 |
| 4,640,767 | 2/1987 | Zajic et al. | 208/390 |
| 4,648,964 | 3/1987 | Leto et al. | 208/390 |
| 5,968,349 | 10/1999 | Duyvesteyn et al. | 208/390 |

*Primary Examiner*—Thomas G. Wyse

*Attorney, Agent, or Firm*—Hopgood, Calimafde, Kalil & Judlowe

[57] ABSTRACT

A process for the biological treatment of bitumen froth tailings produced from a tar sands treatment and bitumen froth extraction process is disclosed. In this process bitumen froth tailings, containing native hydrocarbon metabolizing microorganisms, are mixed with a growth media to form an inoculum which is then incubated under isothermal conditions for an amount of time to produce a mixed bacterial culture containing bioliquor and a water product containing a reduced amount of asphaltenes as well as solids such as clays and sands. The bioliquor produced in this process is then utilized in the initial tar sands conditioning process from which bitumen froth is produced as well as in the initial tar sands mining process via bioliquor injection directly into the tar sands formation. Because the mixed bacterial culture is made up of a number of hydrocarbon metabolizing microorganisms, the bioliquor is also used in the degradation of the asphaltenes. The treatment results in a process for decreasing the amount of waste produced in bitumen extraction processes. Furthermore, because the invention utilizes a biosurfactant containing bioliquor in the initial tar sands conditioning process, bitumen froth can be produced at lower temperatures and without requiring the use of caustic soda, as is conventionally practiced. Thus, the present invention advantageously avoids the production of tailings sludges caused by clay dispersion.

23 Claims, 1 Drawing Sheet

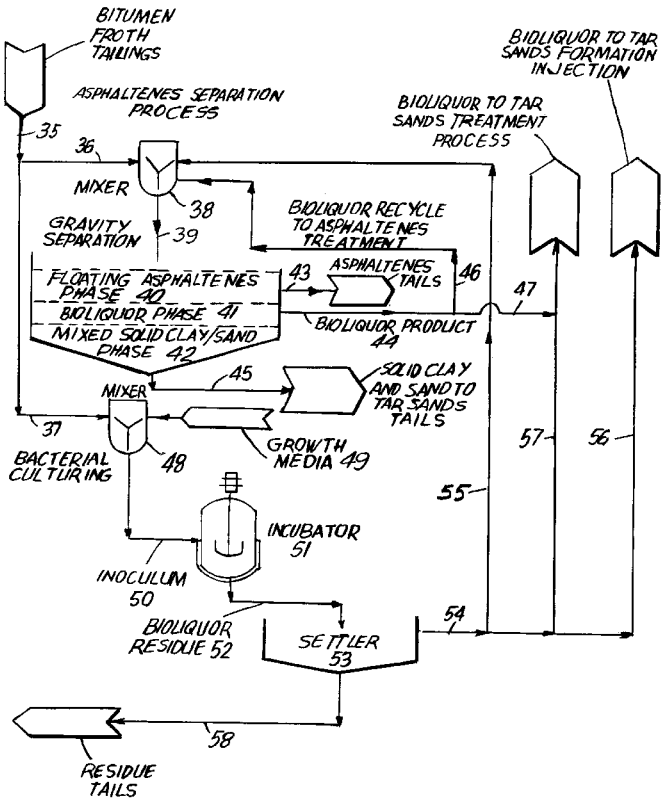

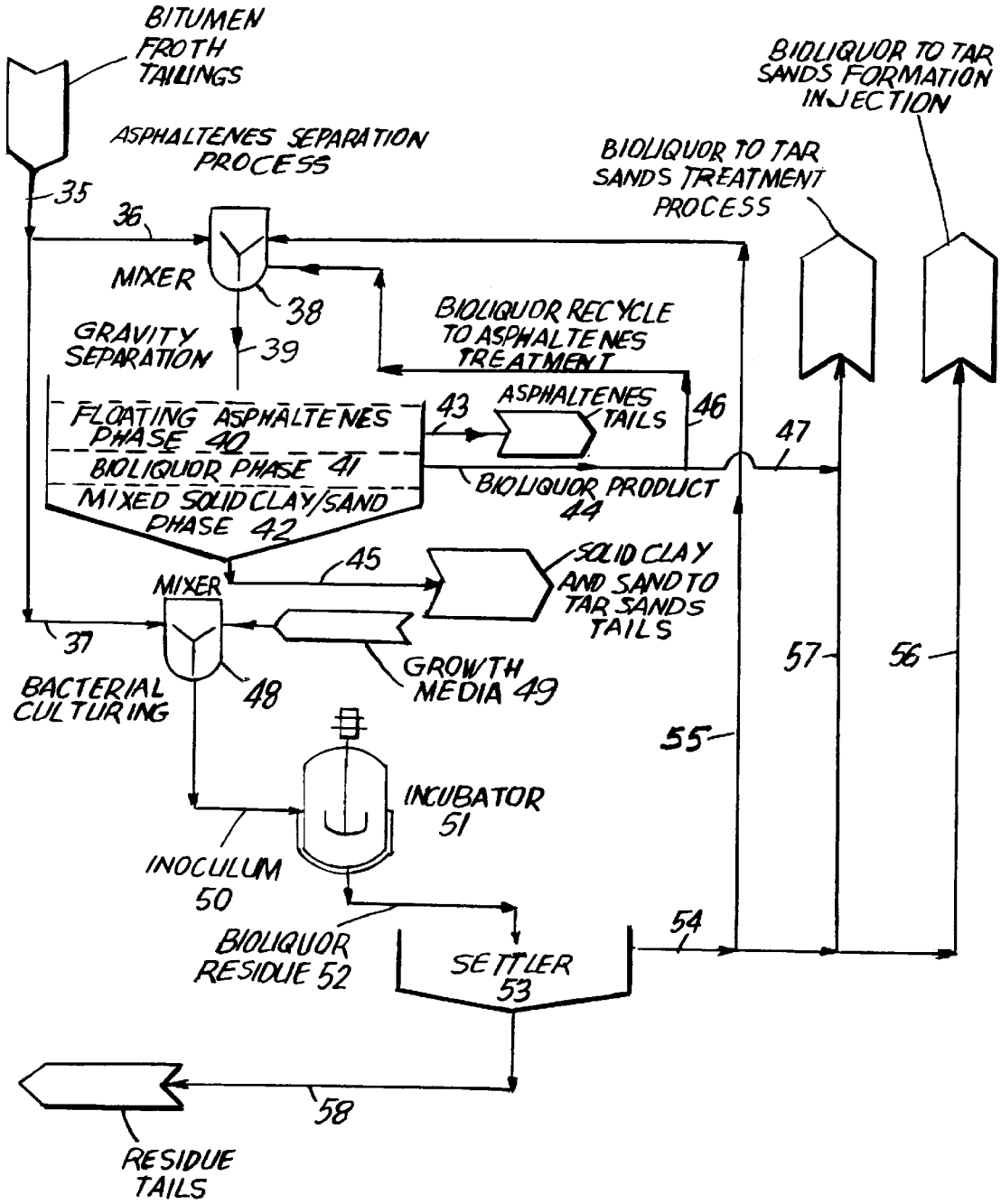
BITUMEN FROTH TAILINGS
ASPHALTENES SEPARATION PROCESS
BIOLIQUOR TO TAR SANDS FORMATION INJECTION
BIOLIQUOR TO TAR SANDS TREATMENT PROCESS
35
36
MIXER
38
GRAVITY SEPARATION
39
BIOLIQUOR RECYCLE TO ASPHALTENES TREATMENT
FLOATING ASPHALTENES PHASE 40
BIOLIQUOR PHASE 41
MIXED SOLID CLAY/SAND PHASE 42
43
ASPHALTENES TAILS
46
47
BIOLIQUOR PRODUCT 44
45
SOLID CLAY AND SAND TO TAR SANDS TAILS
MIXER
37
BACTERIAL CULTURING
48
GROWTH MEDIA 49
57
56
55
INCUBATOR 51
INOCULUM 50
BIOLIQUOR RESIDUE 52
SETTLER 53
54
58
RESIDUE TAILS

BIOCHEMICAL TREATMENT OF BITUMEN FROTH TAILINGS

FIELD OF THE INVENTION

The present invention relates to the biotreatment of bitumen froth tailings produced as a bi-product during the extraction of bitumen from bitumen froth generated from tar sands. Although the present invention is aimed at the treatment of bitumen froth tailings produced by a counter-current decantation (CCD) process outlined herein and also described and claimed in copending U.S. appliction Ser. No. 09/192,892 filed Nov. 16, 1998, now U.S. Pat. No. 5,968,349, it should be understood that the present invention may be utilized in the treatment of any asphaltenes waste produced during the treatment of tar sands.

BACKGROUND OF THE INVENTION

Throughout the world, considerable oil reserves are locked in the form of tar sands, also called bitumen sands. For example, the Athabasca tar sands deposit located in northeastern Alberta, Canada, is the largest of the four major Alberta deposits and contains oil reserves substantially in excess of 150 billion barrels over a total area of 32,000 square kilometers. Another such tar sands deposit exists in the Tar Sand Triangle located in a triangularly shaped area between the Dirty Devil River and the Colorado River in southeastern Utah. The Tar Sand Triangle deposit contains reserves of 12–16 billion barrels of oil in place and covers an area of approximately 518 square kilometers. However, the fact that the oil, in the form of bitumen, is intimately mixed with sand, water, sand silt, complicates the problem of extracting oil efficiently.

Various methods have been proposed to separate the bitumen product from the tar sands as a single component. In one method, the bitumen separated from the sands is coked to produce coker distillate which may be later refined in accordance with conventional refinery practice. In the alternative, it has been proposed that the raw tar sands be treated in a retort in either a moving or fluid bed to produce a coker distillate in which the coke which deposits on the sand is burned to provide process heat.

However, the foregoing processes have their disadvantages in that during coking, the distillate is cracked. While cracking may be desirable for obtaining economic yields, there is usually some degradation of the distillate quality.

One attempt to overcome these disadvantages is disclosed and claimed in U.S. Pat. No. 2,871,180. The method described in this patent for separating crude oil from bituminous sands in asphalted oil enriched layer and an asphaltene enriched layer is to provide an aqueous pulp of the sands into a vertical extraction zone. A low molecular weight paraffinic hydrocarbon (propane) is then introduced into the extraction zone at a level below the point of introduction of the aqueous bituminous sand pulp.

Essentially, the low molecular weight paraffinic hydrocarbon flows upwardly through the extraction zone while the heavier aqueous bituminous sand pulp flows downwardly. These opposing upward and downward flows result in the formation of a deasphalted oil and solvent phase (i.e. the product phase), an asphaltenes phase diluted with a lesser portion of the solvent, a water phase, and a substantially oil-free sand phase, said phases having increasing specific gravities in the order presented. The phases are then removed for further treatment. However, this process presented several economic disadvantages that limited its use and commercial applicability.

Conventionally, the hot water extraction process, which avoids some of the disadvantages presented by the above methods, is utilized in the recovery of bitumen from the sand and other material in which it is bound. After the bitumen is recovered, it is then treated to obtain oil products therefrom. One such example of this process is disclosed in U.S. Pat. No. 5,626,743, which is incorporated herein by reference.

According to the prior art discussed in the aforementioned patent, a water extraction process is described in which tar sands are first conditioned in large conditioning drums or tumblers with the addition of caustic soda (NaOH) and water at a temperature of about 85° C. The tumblers provide means for steam injection and positive physical action to mix the resultant slurry vigorously, causing the bitumen to be separated and aerated to form a bitumen froth.

The slurry from the tumblers is then screened to separate out the larger debris and passed to a separating cell where settling time is provided to allow the slurry to separate. As the slurry settles, the bitumen froth rises to the surface and the sand particles and sediments fall to the bottom. A middle viscous sludge layer, termed middling, contains dispersed clay particles and some trapped bitumen that is not able to rise due to the viscosity of the sludge. Once the slurry has settled, the froth is skimmed off for froth treatment and the sediment layer is passed to a tailings pond. The middling is often fed to a secondary flotation stage for further bitumen froth recovery.

U.S. Pat. No. 5,626,743 discloses a modified prior art water extraction process which is referred to as the hydrotransport system. In this system, the tar sands are mixed with water and caustic soda at the mine site and the resultant slurry is transported to the extraction unit in a large pipe. During the hydrotransport, the tar sands are conditioned and the bitumen is aerated to form a froth. This system replaces the manual or mechanical transport of the tar sands to the extraction unit and thus eliminates the need for tumblers.

The bitumen froth from either process contains bitumen, solids, and trapped water. The solids that are present in the froth are in the form of clays, silt, and some sand. The froth contains about 60% by weight bitumen, which is in itself composed of about 10 to 20% by weight asphaltenes, about 30% by weight water, and about 10% by weight solids. The froth is passed from the separating cell to a defrothing or deaerating vessel where the froth is heated and broken to remove the air. Typically, naphtha is then added to solvate the bitumen thus reducing the density of the bitumen and facilitating separation of the bitumen from the water and solids by means of a subsequent centrifugation treatment. The bitumen collected from the centrifuge treatment usually contains about 5 wt % water and solids and can be passed to the refinery for upgrading and subsequent hydrocracking. The water and solids released during the centrifuge treatment are passed to the tailings pond.

The very nature of bitumen renders it difficult to process. This is because bitumen is a complex mixture of various organic species comprised of about 44 wt % white oils, about 22 wt % resins, about 17 wt % dark oils, and about 17 wt % asphaltenes (Bowman, C. W. "Molecular and Interfacial Properties of Athabasca Tar Sands". (Proceedings of the 7th World Petroleum Congress. Vol. 3 Elsevier Publishing Co. 1967).

When bitumen is treated using the conventional naphtha dilution and centrifugation extraction process, considerable problems are encountered. The reason for this is twofold: Firstly, the naphtha diluted bitumen product can contain up to 5 wt % water and solids. Secondly, the naphtha diluent solvates the bitumen as well as the unwanted and dirty asphaltenes contained in the bitumen froth. Because hydrocracking requires a homogeneous feed very low in solids and water, the naphtha diluted bitumen product cannot be fed directly to the hydrocracker. In order to utilize the naphtha diluted bitumen product, it must first be coked to drive off the naphtha solvent and drop out the asphaltenes and solids. Unfortunately, coker upgrading requires an enormous capital outlay and also results in a loss of 10–15% of the bitumen initially available for hydrocracking.

One way to avoid the problems presented by the naphtha dilution of the bitumen is to use a different solvent, such as a paraffinic hydrocarbon. However, the use of a hydrocarbon diluent results in the precipitation of a portion of asphaltenes from the diluted bitumen. Therefore, when the paraffinically diluted bitumen is fed to the centrifugation system, the precipitated asphaltenes may tend to "plug up" the centrifuges which results in increased maintenance due to the necessity of shutting down the system and cleaning the fouled centrifuges. The increased cost of centrifuge maintenance therefore results in reduced throughput and unsatisfactory economics. Furthermore, centrifugation equipment is highly capital and maintenance intensive even during smooth operation.

The tailings produced via the conventional extraction process present further problems. The tailings in the slimes tailings pond are largely a sludge of day, fine sand, water, and some bitumen. During the initial years of residence time, some settling takes place in the lower layer of the pond, releasing some of the trapped water. The water released from the ponds can be recycled back into the water tar sands treatment process. However, the major portion of the tailings remains as sludge indefinitely. The sludge contains some bitumen and high percentages of solids, mainly in the form of suspended silt and clay.

The tailings ponds are costly to build and maintain, and the size of the ponds and their characteristic caustic condition can create serious environmental problems. In addition, environmental concerns exist with respect to the large quantities of water which are required for the extraction and which remain locked in the tailings pond.

It is known that sludge is formed during the initial conditioning of the tar sands with caustic soda due to the fact that caustic soda attacks clay particles. The caustic soda causes the clays, such as montmorillonite clays, to swell and disperse into platelets that are held in suspension and form the gel-like sludge. Since such sludge inhibits the flotation of the bitumen froth in the extraction process, lower grade tar sands containing large amounts of expanding clays cannot be treated satisfactorily using the conventional water caustic soda process.

Therefore, a need exists for an extraction process which does not require the use of caustic soda and which will reduce the formation of sludge and thereby make water increasingly available for recycling and in turn a decrease in the volume of tailings present in the tailings ponds. It would also be highly desirable to avoid the use of naphtha based solvents for bitumen extraction so as to avoid the necessity of coker upgrading of the bitumen product prior to hydrocracking. It would also be highly desirable to avoid the use of centrifuges in the treatment of paraffinicaly diluted bitumen and to decrease the tendency for asphaltenes to plug centrifuges. This is achieved by utilizing a less costly process for efficiently treating diluted bitumen containing precipitated asphaltenes while at the same time maintaining a high throughput accompanied by low maintenance cost and thereby improving process economics. Finally, it would be advantageous to provide a process for treating bitumen froth tailings and produce useful product therefrom.

Processes have been proposed to utilize alternative conditioning reagents other than caustic soda. U.S. Pat. Nos. 4,120,777 and 5,626,743, incorporated herein by reference, disclose two such processes. The former patent discloses the use of soluble metal bicarbonates in place of caustic soda while the latter patent teaches the use of mixtures of sodium and potassium bicarbonates in the presence of calcium and magnesium ion sources. The aim of both of these patents is to avoid the use of caustic soda in the hot water tar sands conditioning process in order to reduce clay dispersion and sludge formation.

U.S. Pat. No. 4,349,633 avoids the use of conditioning reagents in the tar sands conditioning process and instead teaches the use of a suspension of oxidase-synthesizing hydrocarbon metabolizing microorganisms to facilitate the separation or release of bitumen from sand, clays, and water in the tar sands. This patent has the disadvantage in that part of the higher value, molecular weight hydrocarbon is converted and consumed.

However, such processes have not been adopted by the industry for the reason that they substantially increase the cost of bitumen extraction from tar sands and also due to the higher cost of reagents employed. Furthermore, such processes often result in lower tar sands conditioning rates and tend to adversely affect product throughput. Finally, although such processes may avoid the production of sludges and their inherent problems, none of the proposed prior art processes address the problem of coker upgrading of naphtha diluted bitumen or the additional problem of centrifuge plugging which occurs with paraffinically diluted bitumen. Nor does the prior art teach biochemical treatment of bitumen froth tailings.

THE DRAWING

The accompanying FIGURE is a flowsheet illustrative of the novel process provided by the invention.

SUMMARY OF THE INVENTION

A unique, efficient, and novel process has been developed for the extraction of bitumen from bitumen froth generated from tar sands. According to the novel inventive process disclosed and claimed herein, bitumen froth is first extracted from tar sands using a warm water process. The froth is then treated in a counter-current decantation circuit utilizing a paraffinic hydrocarbon as a solvent to remove precipitated asphaltenes, water, and solids from the bitumen froth and produce a diluted bitumen product. The precipitated asphaltenes, water, and solids produced from the bitumen froth extraction are then treated biochemically in order to reduce the amount of waste and also to produce a bioliquor product for use in the initial tar sands conditioning process and also for use in the mining of tar sand deposits.

Advantageously, as stated hereinbefore, the present invention does not require the use of caustic soda to condition the tar sands and thereby avoids clay dispersion and the attendant formation of sludge. Moreover, temperatures much lower than 85° C. normally used can be used to treat tar sands. Typically, the tar sands conditoning step of the present invention is carried out at a temperature range of approximately 25° C. to 55° C. and preferably at a temperature of approximately 35° C. The decrease in the temperature required for conditioning tar sands results in low energy costs and improved process economics.

The present invention is directed to a process in which the bitumen froth tailings produced from the CCD circuit are treated biochemically using a mixed bacterial culture produced from tar sands or bacterial culture obtained from a non-indigenous source. The utilization of this biotreatment step not only results in a lower waste volume due to the presence of asphaltenes but also results in the production of a bioliquor which finds use in the initial tar sands conditioning process and also in the mining of the tar sands. It should be understood, however, that the present invention may be used to treat bitumen froth tailings produced from any known method of bitumen extraction from bitumen froth obtained from tar sands.

According to another aspect of the present invention, a process is provided for the biochemical treatment of bitumen froth tailings produced during the extraction of bitumen from bitumen froth generated from tar sands.

The process comprises the steps of:

a) providing bitumen froth tailings comprising either separately or intimately mixed residual bitumen, solvent,precipitated asphaltenes, sand, clay, and water;

b) isolating a mixed bacterial culture from said bitumen froth tailings by inoculating a liquid growth medium with a portion of said bitumen froth tailings to form an inoculum;

c) incubating said inoculum in a constantly stirred, isothermal environment for an amount of time sufficient to produce solid-liquid mixture comprising a bioliquor phase, containing biosurfactants, paraffinic solvent and water, including a solids phase containing residual bitumen, a reduced amount of precipitated asphaltenes, sand, clay, and biomass;

d) separating said solid-liquid mixture to produce a separate liquid bioliquor product and solid residue tailing;

e) utilizing a portion of said bioliquor product for the initial tar sands conditioning process;

f) utilizing a portion of said bioliquor product for the asphaltenes separation process;

g) utilizing a portion of said bioliquor product for the mining of tar sands via direct injection of the bioliquor product into tar sands deposit; and h) discarding said solid residue tailing produced in step d).

According to a further aspect of the present invention, a process is provided for the biochemical treatment of the bitumen froth tailings in which a mixed bacterial culture, originally present in the bitumen froth tailings is further cultured with a nutrient in order to provide a microorganism population useful for asphaltenes degradation and for the concurrent production of a bioliquor for use in the initial tar sands conditioning and tar sands mining processes.

Because the present invention does not require the use of caustic in the initial tar sands conditioning process, it does not produce clay dispersion sludges. In addition, because the instant invention utilizes a biotreatment process for treating the precipitated asphaltenes waste product, a more efficient and environmentally acceptable tar sands treatment process is provided.

The objects and advantages of the instant invention will be more fully understood from the following detailed description of the invention, taken in conjunction with the accompanying drawing and examples.

DETAILED DESCRIPTION OF THE INVENTION

The instant invention has as its main aim the treatment of bitumen froth tailings using a novel biotreatment process for treating precipitated asphaltenes waste product. The invention significantly reduces the amount of waste produced in conventional tar sands treatment processes and provides a useful bioliquor product which may be used in the initial tar sands conditioning process and by recycling the bioliquor to the mining of tar sands.

The present invention also has as its object a tar sands water-conditioning process that does not require the use of caustic soda as called for in the prior art. The present invention substantially minimizes, if not avoids, the production of tailings sludge, that is to say, clay dispersions. However, it should be understood that the present invention may be practiced to treat bitumen froth tailings produced from any known bitumen froth treatment process.

Referring to the flowsheet, a process flow diagram of the present invention is illustrated.

Bitumen froth tailings 35, produced as a by-product during the recovery of bitumen from bitumen froth, are transferred via conduit 36 to asphaltenes separation mixer 38 with a portion of the bitumen froth tailings transferred through conduit 37 to bacterial culturing mixer 48. The remaining bitumen froth is fed to gravity separation via conduit 39 to be discussed later Stream 37 entering mixer 48 is mixed with bacterial growth media or nutrient 49 to produce a bacterial inoculum which exits mixer 48 through conduit 50 and enters incubator 51. The function of incubator 51 is to increase the population of the mixed bacterial culture initially present in the bitumen froth tailings by incubating the bacteria in the presence of nutrient 49 at constant temperature and for an amount of time to produce a bioliquor containing an increased concentration or population of microorganisms and a residue consisting essentially of a reduced amount of asphaltenes as well as solids such as clay and sand.

The process of asphaltenes degradation and biosurfactant production taught by the present invention comprises three basic steps: (1) mixed bacterial population development, (2) asphaltenes degradation via hydrocarbon metabolization with the produced mixed bacterial culture and (3) the subsequent production of a biosurfactant containing a bioliquor by-product.

The microorganisms utilized in this process are referred to as "mixed bacterial culture" because they exist as a consortium of different microorganism species. The type and relative amount of each microorganism species present in the "mixed bacterial culture" is a function of both the tar sands origin, overall composition, and bacterial incubation procedures. In general, the microorganisms making up the mixed bacterial culture are those microorganisms which are naturally present in the tar sands.

It should be understood, however, that other hydrocarbon metabolizing microorganisms which are useful in the degradation of asphaltenes may be added to the process as pure or mixed cultures from another source, e.g., a non-indigenous source. Thus, microorganisms may be utilized in the present invention either as a pure culture, or as mixed cultures, so as to provide optimal results in achieving a satisfactory level of asphaltenes degradation and biosurfactant production from tar sands obtained from any specific geological location.

The microorganisms identified and isolated for use in the instant invention as hydrocarbon metabolizing microorganisms are listed in Table 1.

TABLE 1

Identification of Isolated Hydrocarbon Metabolizing Microorganisms

| | |
|---|---|
| Pseudomonas | aeruglnosa |
| | arvilla |
| | alkanolytica |
| | cresorensis |
| | dacunhae |
| | desmolyica |
| | oleovorons |
| | putida |

TABLE 1-continued

| Identification of Isolated Hydrocarbon Metabolizing Microorganisms | |
|---|---|
| | rathonis |
| | salopia |
| | chloroaphis |
| | sp. |
| Corynebacterium | hydrocarboclastus |
| | hydrocarboaxydans |
| | peirophilum |
| | diaxydans |
| | alkatrum |
| | sp. |
| Flavobacterium | axydans |
| | devorons |
| | resinovorum |
| | sp. |
| Nocardia | butanica |
| | corallina |
| | hydrocarbonoxydans |
| | paraffinca |
| | opaco |
| | salmonicolor |
| | rubra |
| | rubropertincta |
| | amarae |
| | aurontia |
| | erythropolis |
| | minima |
| | naepaca |
| | keratolytica |
| | petroleophila |
| | sp. |
| Arthrobacter | paruffineus |
| | hydrocarboglutamicu |
| | oxydans |
| | simplex |
| | alkanicus |
| | sp. |
| Micrococcus | glutamicus |
| | paraffinolyricus |
| | auratiocus |
| | cerificans |
| | conglomeaius |
| | varlans |
| | sp. |
| Mycabacterium | aurum |
| | chitae |
| | cunearum |
| | paraffinicum |
| | phlei |
| | petroleophilum |
| | rhodochrous |
| | novum |
| | thermoresistibile |
| | terrae |
| | sp. |
| Streplarnyces | argentelus |
| | aureus |
| | californicus |
| | fradiae |
| | griseus |
| | sp. |
| Achromobacter | paraffinoclastus |
| | cycloclasies |
| | delicatulus |
| | nitriloclasies |
| | paravulus |
| | pestifer |
| | sp. |
| Rhodococcus | rhodochrous |
| Bacillus | sphaericus |

The microorganisms identified may be cultured in an aqueous growth medium or nutrient containing required quantities of nutrients such as nitrogen, phosphates, alkali metal salts, trace elements, etc.

Preferred nutrients include, $Na_2SO_4$, $MgSO_4.7H_2O$, KCl, $FeSO_4.7H_2O$, and $K_2HPO_4$. More preferably, based on per liter of water, the aforementioned nutrients are present in the following amounts: 3.0 grams $Na_2SO_4$, about 0.5 grams $MgSO_4.7H_2O$, about 0.5 grams KCl, about 0.01 grams $FeSO_4.7H_2O$ and about 1.0 grams $K_2HPO_4$. However, it should be understood that growth medium may contain any nutrient source so long as the amount of nutrient required by the microorganism for efficient growth and maintenance is supplied. The medium is defined as the totality of the nutrients present.

However, it should be noted that the growth medium itself contains no source for carbon source which is required for proper cell growth and maintenance. The carbon source is actually the precipitated asphaltenes contained in the bitumen froth tailings. The asphaltenes are separted and added to the growth media to promote bacterial culturing. It should also be noted that the precipitated asphaltenes reporting to the bacterial culturing step also contains an amount of very dilute bitumen which normally contains short chained alkanes such as pentane or hexane. The pentane and hexane, because they are low molecular weight alkanes, provide an easily assimilable carbon source for the microorganisms. Once the lower molecular weight hydrocarbons have been metabolized, the microorganisms then begin to utilize the precipitated asphaltenes, as well as any bitumen present, as the carbon source. This results in an increase in the microorganism population while at the same time reduce the amount of precipitated asphaltenes.

The growth medium or nutrient is incubated after inoculation with a culture of microorganisms contained in a portion of the bitumen froth tailings 35 for a sufficient period of time to allow growth of the microorganisms. The microorganisms may be cultured to a high concentration to form a stock solution and may also be cultured until a suitable microorganism population or concentration, is achieved.

After culturing, the bioliquor and residue mixture produced in incubator 51 is then transferred via conduit 52 to settler 53 to produce a clarified bioliquor product 54 and a residue underflow which is transferred through conduit 58 as residue tails.

The microorganism culture suspension produced, which is referred to as the "bioliquor", may be utilized in the initial tar sands conditioning process from which the bitumen froth feed is produced or may be utilized in the treatment of the tar sands by injecting the bioliquor directly into the tar sands deposit prior to mining.

The bioliquor is amenable to tar sands conditioning and mining because the bioliquor contains a number of biochemically produced surfactants referred to as "biosurfactants" which are useful in that they enable the bitumen contained in the tar sands to be more efficiently separated from the clay and sands solids.

The bioliquor product exiting settler 53 through conduit 54 is then split into three streams through conduits 55, 56, and 57. The bioliquor transferred in stream 56 reports directly to the tar sands deposit where it is injected into the tar sands. Alternatively, the bioliquor can be injected into a partially depleted or not depleted oil reservoir. In this way, the bioliquor renders the tar sands more amenable to processing prior to mining by substantially separating the bitumen from the sands and clays contained therein.

The bioliquor transferred via conduit 57 reports to the initial tar sands treatment process. As mentioned before, the biosurfactants contained in the bioliquor product are useful in that they enable the bitumen contained in the tar sands (or the oil from a reservoir) to be more efficiently separated from the clay and sands solids also contained in the tar sands. Thus, the initial tar sands processing step from which the bitumen froth is generated can be carried out at low temperatures without the conventional use of caustic soda.

In this way, the tar sands tails produced as a by-product of bitumen froth generation do not contain dispersed clays which would hinder the settling of the solids in the tar sands tailings impoundment. Furthermore, the use of the bioliquor injected into tar sands prior to treatment results in lower bitumen losses to tails and higher levels of bitumen froth production.

Because the production of bioliquor is the direct result of asphaltenes degradation in which the bacterial mixture utilizes the asphaltenes as an energy source, the amount of asphaltenes waste produced can be reduced or completely eliminated through bioliquor production. Therefore, the bioliquor transferred from settler 53 to and through conduit 55 reports to mixer 38 where it is mixed with a portion of the bitumen froth tailings 36 in mixer 38. After agitation in mixer 38, a mixture comprising a reduced amount of asphaltenes, bioliquor and solids such as sand and clay is transferred via conduit 39 to a gravity separation step which produces a floating asphaltenes phase 40, a bioliquor phase 41 and a mixed sand and clay solids phase 42.

Because of the nature of the biosurfactants contained in the bioliquor, the surface chemistry of the precipitated asphaltenes contained in stream 36 entering mixer 38 is altered causing the precipitated asphaltenes to float. Furthermore, as the surface chemistry is altered, a portion of the precipitated asphaltenes is consumed thus resulting in a reduced amount of precipitated asphaltenes that is easily separated from the mixture. The floating asphaltenes phase 40 produced during gravity separation is then transferred via conduit 43 as asphaltenes tails which are discarded into a tailings impoundment and/or recycled to mixer 38 using at least one valve and conduit not shown. Alternatively, the asphaltenes may be added to mixer 48 to obtain a larger production of bioliquor.

The bioliquor product phase 41 produced during gravity separation is transferred via conduit 44 with a portion of the bioliquor being recycled via conduit 46 for asphaltenes treatment in mixer 38, with a portion of the bioliquor contained in stream 44 transferred to the original tar sands deposit via conduit 47 for processing the tar sands. The mixed solid clay/sand phase 42 produced during gravity separation is transferred via conduit 45 and discarded as tails.

The process of the present invention is further described in the following example which is non-limiting with respect to the scope of the present invention.

EXAMPLE

This example illustrates the production of bioliquor via asphaltenes degradation and the effect of the bioliquor upon bitumen froth production during tar sands conditioning. In order to produce bioliquor for use in tar sands conditioning experiments, an amount of precipitated asphaltenes is inoculated with a previously isolated microorganism culture. After incubation and asphaltenes degradation, the bioliquor is separated from the culture and set aside.

The effectiveness of the bioliquor on bitumen recovery from tar sands was determined utilizing a batch extraction unit. The batch extraction unit (BEU) is essentially an isothermal reactor agitated using an impeller made up of a hollow shaft through which air is injected. The method for determining bitumen recovery via the BEU is as follows:

a) Heat up the conditioning vessel to the desired temperature using a water bath.

b) Weigh 500±0.5 g of homogenized tar sand. Record weight.

c) Weigh 150±0.5 g of conditioning liquid, e.g. tap water, bioliquor, or a mixture of both and record weight.

d) Heat the conditioning liquid to the desired temperature using the heated vessel.

e) Raise vessel and lock it in uppermost position. Turn on/set impeller to 600 rpm.

f) Add the weighed tar sand.

g) Turn on air at source and set the air flow to 150 ml/min.

h) Mix for 30 minutes (conditioning step) and turn off air.

i) Weigh 900 g of tap water at the desired temperature, record weight and add to the conditioned slurry.

j) Mix for 10 minutes (primary flotation).

k) Stop impeller and skim off the primary froth into a preweighed jar. Record weight.

l) Set gas flow to 50 ml/min and the impeller to 800 rpm.

m) Mix for 5 minutes (secondary flotation)

n) Turn off gas and stop impeller o) Skim off the secondary froth into a preweighed jar. Record weight.

p) Open bottom drain plug and drain vessel contents into a preweighed 2 liter stainless steel beaker.

q) Rinse out sand with deionized water from a preweighed wash bottle. Calculate and record weight of the rinse water used. Allow sand to settle for about 1 minute. Decant the aqueous layer into a second preweighed 2 liter stainless steel beaker (secondary tailings). Weight the second beaker and record.

r) Weigh the first beaker and record weight (primary tailings)

s) Remove vessel and impeller from the BEU stand.

t) Wash the vessel, bottom drain plug and impeller with a toluene/isopropanol mixture (63%/37%) in a fume hood. Collect washings and discard into an organic waste drum.

u) Make sure no air sparging holes on the impeller are clogged. If necessary clean the impeller from the inside.

After separation, the amount of bitumen separated is compared to the bitumen originally contained in the tar sands. From this, the bitumen recovery can be calculated on a percentage basis. In this example, the effectiveness of the bioliquor was compared to that of ordinary tap water at different temperatures. The results are given in Table 2, below:

TABLE 2

Conditions Applied and Results Obtained In the Bitumen Liberation Experiments

| Process Temperature (° C.) | Conditioning Liquid (150 g) | Bitumen Recovery (%) |
|---|---|---|
| 25 | Tap Water | 49.5 |
| 25 | Tap Water: Bioliquor; 1:1 | 89.6 |
| 35 | Tap Water | 85.7 |
| 35 | Tap Water: Bioliquor; 1:1 | 84.3 |
| 40 | Tap Water | 94.3 |
| 40 | Tap Water: Bioliquor; 1:1 | 95.1 |

As can be seen from Table 2, there were no major differences in bitumen extraction obtained with tap water vs. a 1:1 mixture of tap water and bioliquor at temperatures above 25° C. However, at a temperature of 25° C., the 1:1 mixture of tap water and bioliquor resulted in a bitumen extraction almost double that of the bitumen extraction achieved with tap water alone.

Therefore, these experiments indicate that the tar sands conditioning process can proceed at ambient temperatures, i.e., 25° C., using the bioliquor produced from asphaltenes degradation and result in bitumen extractions ranging upwards of about 90%. Because the tar sands conditioning process can be carried out at energy saving low temperatures without the conventional addition of caustic soda, bitumen froth can be generated at a significantly lower cost and without the production of clay dispersions which heretofore has plagued the conventional hot water caustic soda tar sands conditioning process.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A process for the biochemical treatment of bitumen froth tailings obtained as a residuum during the extraction of bitumen from bitumen froth produced during the treatment of tar sands using a paraffinic hydrocarbon as a solvent, a) said bitumen froth tailings being characterized by the presence of a bacterial culture of mircroorganisms or by the addition of a non-indigenous bacterial culture, said tailings containing residual bitumen, paraffinic hydrocarbon as a solvent, and also precipitated asphaltenes, sand and clay, b) isolating a portion of said tailings and inoculating it with a solution containing a nutrient specific to the growth of said microorganisms to form an inoculum thereof, c) incubating said inoculum under isothermal conditions for a time sufficient to provide a solid-liquid mixture comprising a bioliquor phase containing biosurfactants, said paraffinic hydrocarbon solvent, including a solids phase, residual bitumen, an amount of precipitated asphaltenes, sand, clay and a biomass, and d) separating said solid-liquid mixture and thereby producing a separate bioliquor product and a solid residue.

2. The process as set forth in claim 1, wherein said tar sands are water-containing tar sands.

3. The process as set forth in claim 1, wherein said bitumen froth tailings are produced during a counter-current decantation treatment of bitumen froth using a paraffinic hydrocarbon as a solvent.

4. The process as set forth in claim 1, wherein said bioliquor product produced in step (d) is again inoculated with a portion of said bitumen froth tailings containing microorganisms and a nutrient therefor added to form a second inoculum followed by incubation and separation as set forth in said steps (c) and (d), respectively, to form a second bioliquor product and a second solid residue tailing.

5. The process as set forth in claim 4, wherein said second bioliquor product produced, is repeated a third and fourth time, thereby producing a third bioliquor product and third solid residue tailing and a fourth bioliquor product and fourth solid residue tailing.

6. The process as set forth in claim 1, wherein said bioliquor product is utilized for injection into a tar sands deposit for the recovery of tar sands, said tar sands deposit existing at a depth which renders conventional tar sands recovery processes uneconomical.

7. The process as set forth in claim 1, wherein said bioliquor produced is utilized for injection into an oil reservoir for the recovery of bitumen and oil therefrom.

8. The process as set forth in claim 7, wherein said oil reservoir has been partially depleted of its oil content.

9. The process as set forth in claims 1 and 2, wherein said bioliquor product is recycled to said water-containing tar sands at ambient temperature to produce bitumen froth tailings.

10. The process as set forth in claim 1, wherein said bioliquor product is utilized in an asphaltenes separation step by mixing said bioliquor product with a portion of said bitumen froth tailings for an amount of time and at a temperature sufficient to form three-phase layers comprising a floating solid asphaltenes phase, a bioliquor layer containing residual bitumen, paraffinic solvent, water, and a bottom layer containing a mixture of solid clay and sand.

11. The process as set forth in claim 10, wherein said three-layers are separated to produce solid asphaltene tailings, a bioliquor product, and a mixture of solid clay and said residue.

12. The process as set forth in claim 11, wherein said mixed solid clay and sand residues are mixed with tar sands tailings for final disposal.

13. The process as set forth in claim 11, wherein said bioliquor product is recycled to said water-containing tar sands to produce bitumen froth.

14. The process as set forth in claim 10, wherein said bioliquor product is recycled to said asphaltenes separation step.

15. The process as set forth in claim 14, wherein said asphaltenes separation step is carried out at ambient temperature.

16. The process as set forth in claim 15, wherein said asphaltenes separation step is carried out for approximately 30 minutes.

17. The process as set forth in claim 13, wherein the treatment of said water containing tar sands is carried out at a temperature of up to approximately 55° C.

18. The process as set forth in claim 1, wherein said nutrient for the microorganisms is comprised of a solution of at least one mineral salt.

19. The process as set forth in claim 18, wherein said liquid mineral salt is substantially free of organic carbon source materials.

20. The process as set forth in claim 19 wherein said mineral salt nutrient solution contains approximately 3.0 grams $Na_2SO_4$ per liter of solution, approximately 0.5 grams $MgSO_4.7H_2O$ per liter of solution, approximately 0.5 grams KCl per liter of solution, approximately 0.01 grams $FeSO_4.7H_2O$ per liter of solution and approximately 1.0 grams $K_2HPO_4$ per liter of solution.

21. The process as set forth of claim 1, wherein the bacterial culture is selected from the group consisting of Pseudomonas sp., carynebacterium sp., flavobacterium sp., Nocardia sp., Arthrobacter sp., Micrococcus sp., Mycabacterium sp., streplamyces sp., and Achromobacter sp.

22. The process as set forth in claim 1, wherein the bacterial culture is *Rhodococcus rhodochrous*.

23. The process as set forth in claim 1, wherein the bacterial culture is *Bacillus sphaericus*.

* * * * *